US005257464A

United States Patent [19]

Trevino-Gonzales

[11] Patent Number: 5,257,464

[45] Date of Patent: Nov. 2, 1993

[54] SYSTEM AND METHOD OF CURING CONCRETE PRODUCTS IN A KILN

[76] Inventor: Francisco Trevino-Gonzales, 5a Ave 609 Cumbres 1er Sector, Monterrey, N.L., Mexico, 64610

[21] Appl. No.: 990,056

[22] Filed: Dec. 14, 1992

[51] Int. Cl.5 ..... F26B 3/00

[52] U.S. Cl. ..... 34/26; 34/60; 264/82; 264/DIG. 43

[58] Field of Search ..... 34/50, 12, 60, 32, 26, 34/30, 218; 264/82, 40.6, 333, DIG. 43

[56] References Cited

U.S. PATENT DOCUMENTS 1,218,261 3/1917 Hunter ..... 34/50
3,492,385 1/1970 Simunic .
4,099,337 7/1978 Wauhop, Jr. .
4,427,610 1/1984 Murray .

*Primary Examiner*—Henry A. Bennet
*Attorney, Agent, or Firm*—Laurence R. Brown

[57] ABSTRACT

A system for curing concrete products resident in a kiln, in particularly for producing high strength building blocks from relatively dry green concrete, controls temperature and humidity in the kiln as a function of time in the curing cycle from a water pool heated by underwater grates near the upper water surface. Heated air and air/$CO_2$ mixture also is circulated in the kiln during relevant portions of the curing cycle. Accelerated evaporation from the water well is induced by ruffling the water surface with the circulated air with enough intensity that the grates are uncovered to quickly evaporate water films wetting the grate surfaces. A baffle structure thus directs circulating air into the water surface. Individual grates are heated at critical times during the heating cycle in a manner to control temperature of different zones within the kiln by means of circulating hot liquids, such as oil. For example the temperatures at each grate may respond to thermostats controlling liquid flow valves for the respective grates. The comprehensive system may be automatically controlled by a computerized control system during curing cycles as a function of time to provide critical curing conditions including: (1) early cooling during exothermic reactions in the green concrete, (2) intermediate humidification to prevent drying of the partly cured concrete, (3) providing $CO_2$ rich heated circulating air for curing the concrete and (4) heating with dry air near the end of the curing cycle for drying out the concrete.

23 Claims, 4 Drawing Sheets

SYSTEM AND METHOD OF CURING CONCRETE PRODUCTS IN A KILN

TECHNICAL FIELD

This invention relates to curing concrete products in a kiln and more particularly it relates to kilns controlling heat and humidity during a curing cycle by means of a pool of water in the kiln and methods of curing concrete.

BACKGROUND ART

In order to produce concrete products of good quality and high strength essential for building blocks, the curing cycle for the concrete is critical. Thus, the temperature, carbon dioxide and humidity must be controlled at various times during the curing cycle. For example, Simunic in U.S. Pat. No. 3,492,385, Jan. 27, 1970 proposes a conveyor system for passing the products through alternating hot and cold regions, while varying hot air temperature and carbon dioxide content and introducing humidity with sprayed water during the curing cycle.

This system however imposes considerable disadvantages, in part because of complex and expensive kiln construction having a limited life because of the necessity to operate a moving conveyor system through the corrosive kiln atmosphere. Also, the energy expenditure is high because of the cyclic requirement to cool hot products and heat cooled products. Quality of products such as building blocks formed of dry mixture would be difficult to maintain, because of the difficulty in preventing cracks or breakage of products during exothermic or water exhaustion phases of the curing cycle. Also, green concrete, particularly fragile dry-mix concrete for building blocks, can be damaged in moving during the green phase. Controls of the curing cycle in this system cannot be controlled critically enough to reduce energy, or to increase quality by reduction of breakage or weakening during the curing process, for example because exothermic curing reaction causes excessive temperatures and dry heating air isolated from the humidifying regions may cause excessive water loss and thus fissures or cracks curing critical cure phases.

Thus, it is an objective of this invention to produce more efficient, longer life kilns needing little maintenance and better control of curing cycle conditions, thereby leading to improved quality products produced at lower cost.

Similarly concrete products are conveyed through a kiln in Murray, U.S. Pat. No. 4,427,610, Jan. 14, 1984, inconsistent with the fragile status of green concrete building blocks. In this system the products are cured by air of controlled temperature and $CO_2$ content. This kiln and curing method however is subject to the same criticism regarding kiln life and maintenance, and further fails to control the humidity level, critical to quality and strength by the prevention of excessive water losses from the product pores causing fissures and cracking.

Humidity is maintained greater than 90% throughout the curing cycle by Wauhop, Jr., U.S. Pat. No. 4,099,337, Jul. 11, 1978. Thus a water bath in the kiln by evaporation and diffusion through the kiln as aided by water sprayed on the pool surface, provides a substantially constant kiln humidity and temperature through which the products on pallets are moved and discharged after about six hours of curing. This system requires a long curing time and moves the fragile products at all cure stages through the kiln, and thus introduces the aforementioned problems of product strength, kiln life and kiln maintenance. Furthermore, this system is deficient in being able to control the atmosphere inside the kiln in a manner consistent with an optimized curing cycle.

It is therefore a general objective of this invention to improve the state of the concrete curing art by introducing improved kilns and curing methods. Other objects, features and advantages of the invention will be recognized from the following description, drawings and claims.

DISCLOSURE OF THE INVENTION

A stationary charge of concrete products in the kiln has the products arranged two-dimensionally on pallets along a longitudinal kiln array provided with a lowermost well carrying water of variable temperature, thereby contributing to the kiln temperature control system, and providing a humidifying source. The well water is heated by means of underwater grates distributed along the well length and disposed near the upper surface of the water. The grate temperature is varied, zone by zone, along the length of the kiln by means of pumped heated liquid, such as oil flowing through the grates. This heating liquid is distributed under thermostatic control to valves serving the individual grates so that the temperature in several zones of the kiln may be regulated.

Air pumping fans additionally circulate heated air through the well. $CO_2$ is introduced into the air during the carbonization phase of the curing cycle when it is demanded for accelerating the cure time as the water is released from the product pores. The hot circulating air encourages evaporation from the water to humidify the chamber, a feature enhanced by the provision of baffles for rippling the water. Water and air turbulence is introduced for more effective humidification. Thus, the heated surfaces of underwater hot grates, with residue thin films of water in residence, become exposed thereby to rapidly evaporate the thin films of water adhering to the grates during the dynamic wavestorms induced by circulating air and deflectors into the surface of water in the well. Further deflectors assure circulation of hot-humid air throughout the kiln, and turbulence in the well region to entrain more humidity.

The curing cycle is thus controllable as to temperature, $CO_2$, and humidity as a function of time during the curing cycle as assisted by thermostatic feed-back and predetermined optimized cycle protocol. These controls are readily automated by a computer programmed to control water, air, $CO_2$, pumps and fans.

Typically, an early low-water-temperature cycle portion, typically one hour, establishes a 20 degree C. kiln temperature at a critical time when the concrete in the exothermic phase should be cooled rather than heated. There follows in addition to heating of the water in the well by the exothermic heat, perhaps one hour of a 30 degree C. kiln temperature in the presence of high humidity to prevent the concrete products from drying out too rapidly. For accelerated curing thereafter, the temperature is raised to about 60 degrees C. and $CO_2$ is added for the carbonizing final phase of about an hour. At the end of the cycle, the water is dissipated from the well, so that the cured concrete products are dried with dry heat from the circulating heated air. The kiln and control method of this invention provides flexible controls for cure of different types of concrete products suitable for automation or semi-automation. Furthermore, energy efficiency is assured, as is product quality. The method significantly increases product strength and reduces breakage and rejects, requiring a simple long-life kiln.

Of significance is superior kiln performance, with stationary charges of products eliminating maintenance problems, and loss of energy for continuous entry and removal of products. Long kiln life is assured by the stationary presence of the products in the kiln for the entire curing cycle. The kiln cost is reduced because of simplicity of a closed kiln with removable tops used for loading and unloading concrete products between curing cycles. More detailed construction features and further advantages of the kilns and methods afforded by this invention are set forth with reference to the preferred embodiments of the invention, which follow.

BRIEF DESCRIPTION OF THE DRAWINGS

In the accompanying drawing, wherein like reference characters refer to similar features throughout the various views to facilitate comparison.

THE PREFERRED EMBODIMENTS

Figure 1:
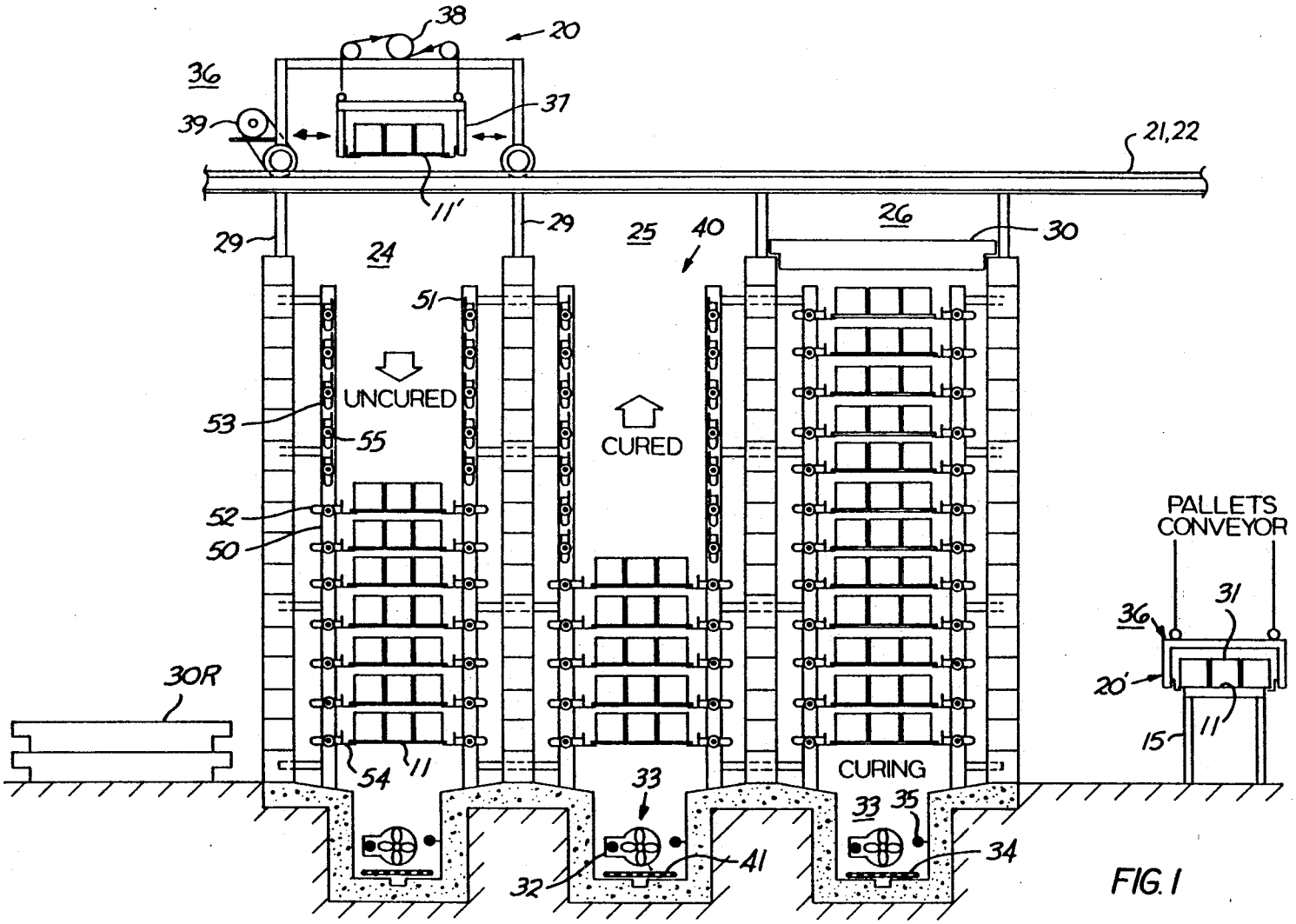
FIG. 1 is an end view, partly in section, of a kiln system embodiment of the invention with accompanying crane for loading and unloading concrete products with kiln top covers removed.

As seen from FIG. 1, three side by side kilns 24, 25, 26 contain during the curing cycle (kiln 26) a stationary charge of concrete products such as building blocks 31 arranged on pallets 11 extending along the kiln length. The open-top kilns have removable covers 30, put in place (kiln 26) during the curing cycle, and removed when loading and unloading from suitable conveyors 15 the pallets of concrete products (24, 25) by means of crane 20 with clamping basket 36. Thus, cured products are removed from kiln 25 from top to bottom layers, and uncured green products are loaded into kiln 25 from bottom to top layers by the crane 20. The pallets 11 are held on movable ledges 54 movable to kiln loading positions 53 by means of toggle assemblies 52 on posts 50, 51.

Of significance for this invention is the curing of the concrete products by way of the heating system contained in wells 33, which comprise both circulating hot air from fan 32 and circulating hot water in grates 34. Heat is monitored and controlled by appropriate thermostats 35 along the length of the wells 33. Thus, during the curing cycle, water covers the grates 34 in wells 33, and the grates receive circulating hot liquid in pipes 41 to control the temperature of the water pool in the well. The water contributes to the kiln atmospheric temperature and humidity necessary during the curing cycle. In addition, hot air mixed with $CO_2$ is circulated by the fans 32 to circulate throughout the stationary charge of concrete products being cured within the kiln (26).

Figure 2:
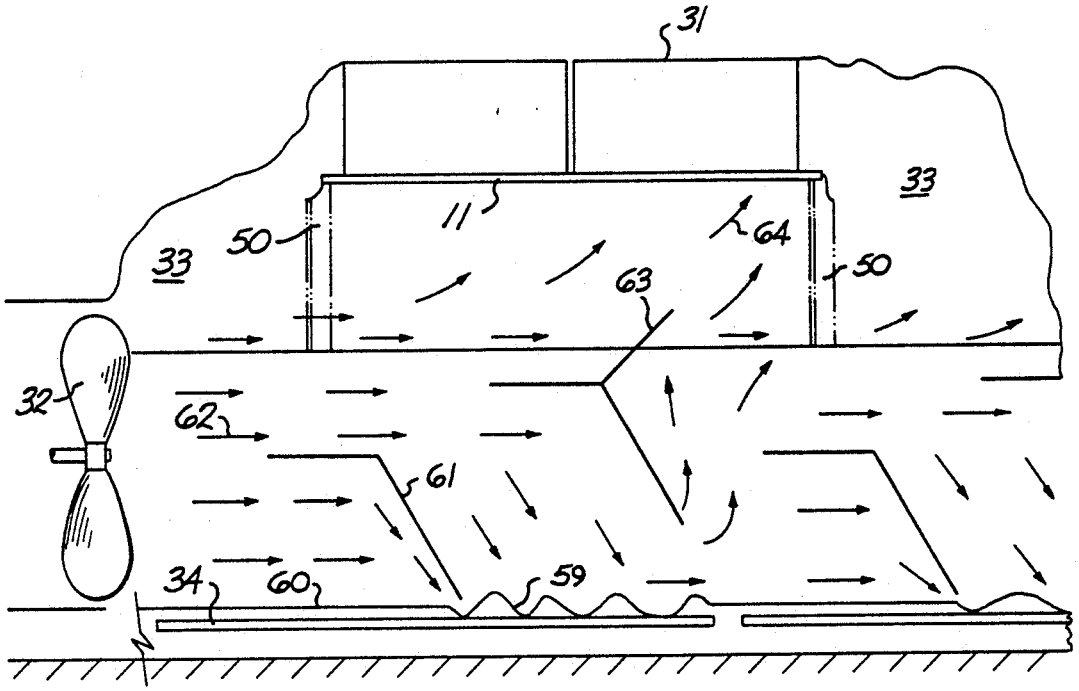
FIG. 2 is a fragmental diagrammatic side view sketch, partly in section, of an air flow baffle deflection system provided by the invention.

In this system the circulating air and resident water 60 in the wells 33 interact synergetically to enhance the curing of the concrete in a manner diagrammatically shown in FIG. 2. The depth of the water 60 is just enough to slightly cover grates 34 during the initial portion of the curing cycle. Location of the upper grate surface about one-quarter inch under water is typical. This enhances evaporation of the water in the well as the grates are heated to increase the humidity within the kiln and thus improve the curing of the concrete products. Furthermore, it is seen that the ripples or waves 59 are induced by the air stream 62 from fan 32 due to the effect of baffle vanes 61 directing air forcefully against the water surface 60 to create turbulence at the water to air interface. This turbulence accelerates entrainment of the water into the kiln atmosphere. Furthermore, the heated grates 34 will be exposed at the bottoms of the waves 59 and the thin film of water thereon is more rapidly evaporated than the water from the surface of the water supply 60 in the well.

Figure 3:
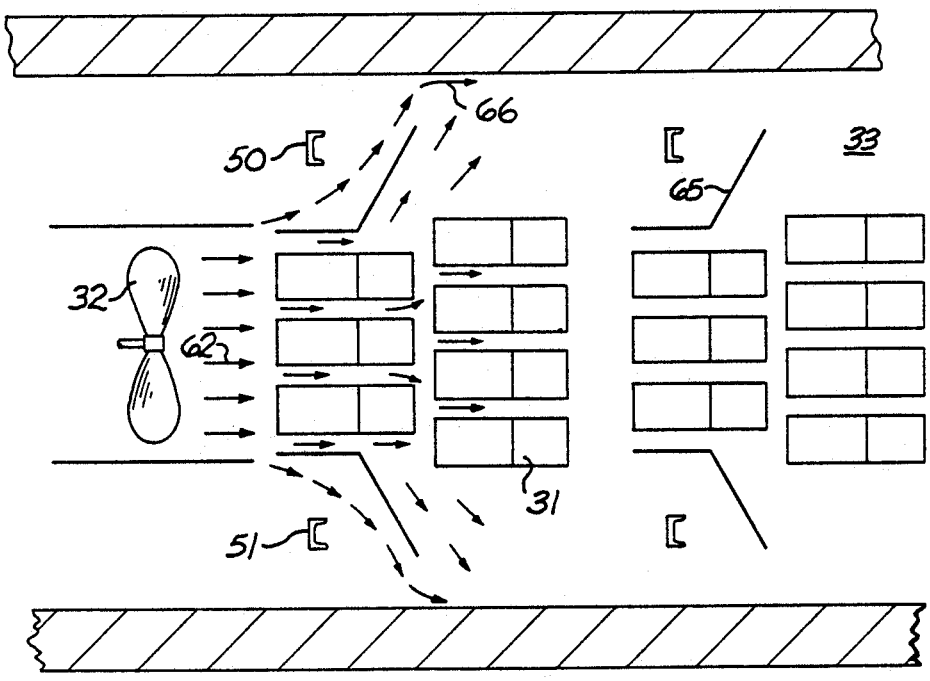
FIG. 3 is a fragmental diagrammatic top view sketch, partly in section, of further baffles in the air flow deflection system.

Circulation of the heated, humid air upwardly into the concrete products 31 along the length of the kiln is further enhanced by baffle vanes 63. Air turbulence caused in the well by the baffles serves to entrain more humidity for circulation among the concrete products 31. This turbulence is further induced by the baffle vanes 65 that direct the air flow (66) into the side walls of the well 33, as shown in FIG. 3.

Figure 4:
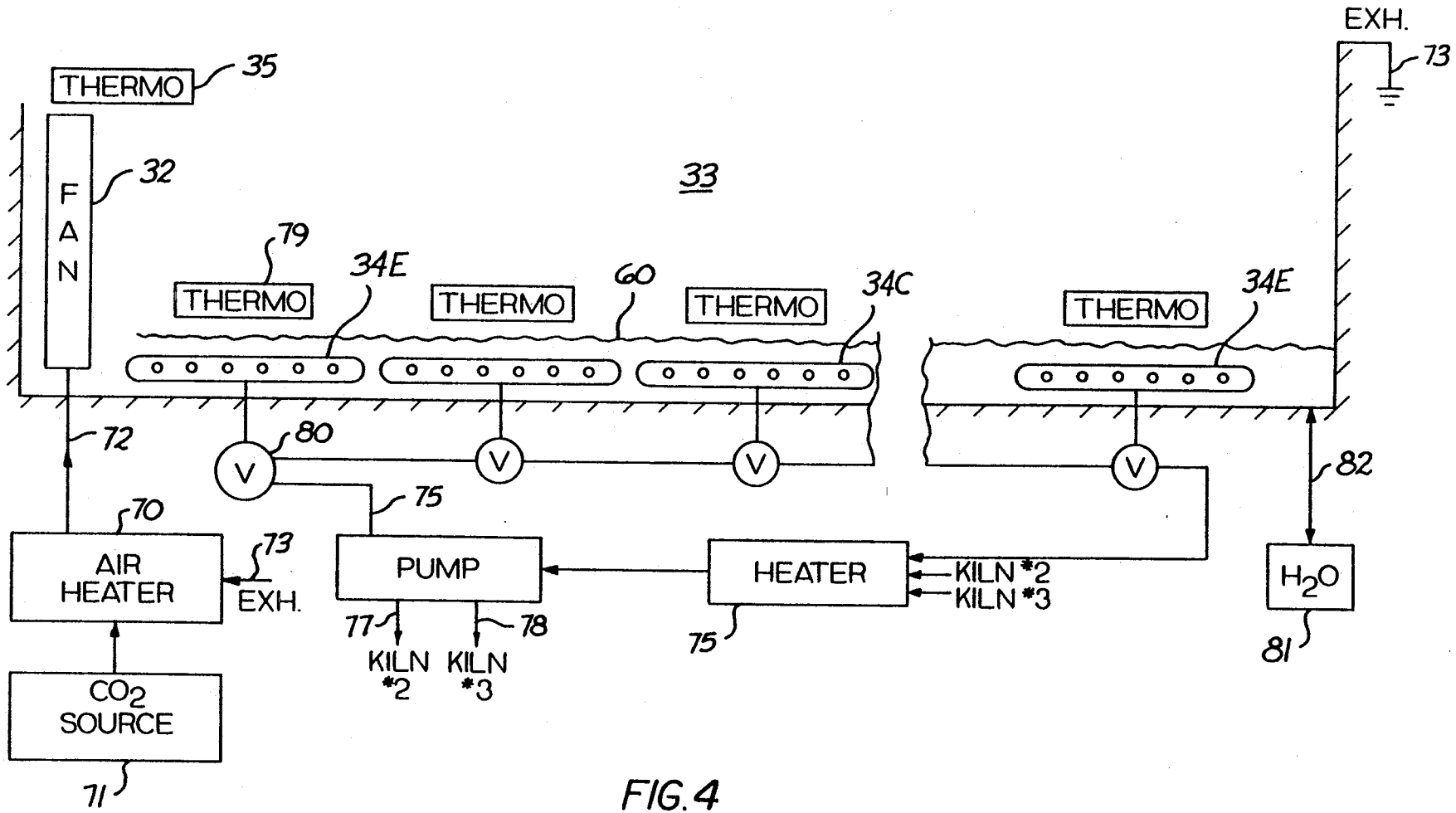
FIG. 4 is a block diagram sketch of the operating system controlling the kiln during a curing cycle by means of circulation circuits for both heating air and heating liquid.

The flexibility of the kiln system apparatus and the curing methods provided by this invention is illustrated by the block diagram of FIG. 4. Although the production of concrete building blocks is important and thus is described in some detail herein, it must be recognized that different concrete products with differing green concrete constituency, and of different physical characteristics, may be custom cured under optimum curing conditions with the kiln and accompanying cure control system afforded by this invention.

Dual temperature control systems, respectively hot air and hot water circulation systems (provided with insulated conduit paths) are shown in FIG. 4, as related to the kiln and well 33 environment heretofore described. Thus hot air from air heater 70 is circulated over the conduit 72 into the well 33 by means of fan 32. The exhaust air 73 is returned to air heater for better fuel efficiency. Also the carbon dioxide source 71, typically from an oil burner exhaust, contributes to the heating and the internal atmosphere of the kiln while enriching the carbon dioxide in air at critical portions of the curing cycle where the concrete is carbonated. The thermostat 35 is used to monitor and control the air temperature in the kiln, and thus may serve to control the speed and operation of the fan 32.

The hot liquid circulation system under control of pump 74 serves to circulate a liquid heated in heater 75 through the wells in a selected one of the three kilns heretofore described undergoing a curing cycle through one of the circulating lines 76, 77, 78. In a similar way the hot air circulation system may serve three or more kilns. The pump is preferably variable speed so that higher circulation rates for the heated liquid are available at peak energy periods during the curing cycle. At each grate 34 location (typically five) along the length of the well 33, a corresponding thermostat 79 may sense the local air or water temperature, so that the respective grate valves 80 circulate the hot liquid at a desired rate through the grates may be controlled to maintain a scheduled local water 60 temperature for different portions of the curing cycle. The valves thus serve to supply heated liquid flowing within the grates 34 at a rate to attain the desired well water temperature. This serves both to raise the temperature of the kiln atmosphere and to supply heat lost in the curing cycle. The circulating hot liquid may be water, preferably filtered and chemically treated to reduce corrosion induced by high temperatures, etc., or alternatively oil. Oil is not corrosive and may be heated to higher temperatures without introducing steam, if desired.

Initially water 60 is supplied from a source 81 to an appropriate level monitored, for example, by a float valve or the like, and if necessary drained at the end of the curing cycle, or for maintenance in the kiln, etc. as indicated by the double headed arrow 82.

Figure 5:
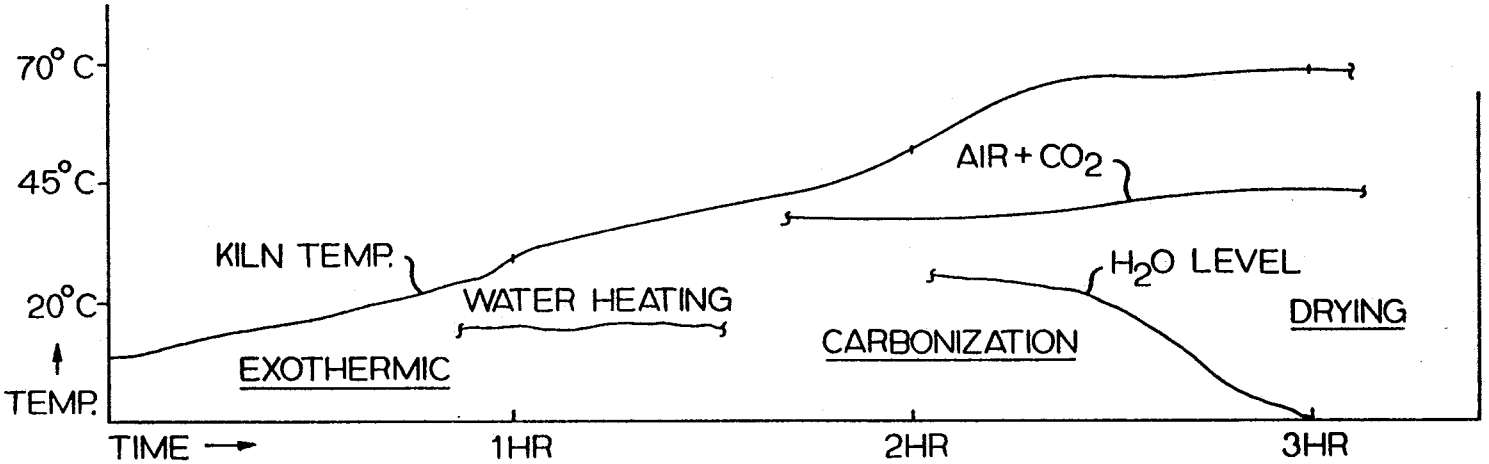
FIG. 5 is a chart illustrating kiln conditions during a typical cure cycle for concrete building blocks.

Thus, the relatively simple air and water circulation systems and corresponding controllable units provide significant flexibility in control of a curing cycle to meet optimum conditions. The chart of FIG. 5 is illustrative of a controlled curing cycle for the critical curing of concrete building blocks formed of green concrete of a relatively dry mix, and therefore fragile for handling in the green stage and critical in the following curing process.

Reference will be made to the chart of FIG. 5 and the diagram of FIG. 4 during the following discussion of the curing method afforded by this invention. Each of the heated grates 34 along the length of the kilns is individually controlled in a zone temperature control mode. This permits for example the grates 34E near the end walls to receive more circulated heated liquid than those 34C nearer the center of the kiln, to compensate for heat lost through the end walls of the kiln.

The kiln temperature starts at near 20 degrees C., and the curing cycle in its exothermic phase provides heat for a slow increase in the kiln temperature until an initial water heating and humidification phase is initiated. The humidification is necessary to prevent too rapid a loss of moisture causing the products to become cracked or lose strength. Typically by circulation of 80 degrees C. liquid to the grates, the temperature of the kiln is raised to about 30 degrees C. and the water pool is slowly heated up. At this early stage of the curing cycle only the water contributes to the kiln temperature.

After about one hour, the water temperature is increased to provide a kiln temperature rising to about 50 degrees C. during a second hour of cure. During the third hour of cure, the kiln temperature rises to over 60 degrees C. by means of heated air circulated by the blower. That air is enriched by $CO_2$ to accelerate carbonization by supplying enough $CO_2$ to supplant water being released from internal pores in the products. The water release is retarded by higher humidity in the kiln obtained from the turbulence and the uncovered grates in the manner aforesaid to prevent cracking and fissure caused by rapid escape from the product pores.

Near the end of the cure the water level in the well is dissipated by evaporation and/or drainage so that the products can be dried out in the kiln to reach their high strength final cure condition, ready for immediate use.

Figure 6:
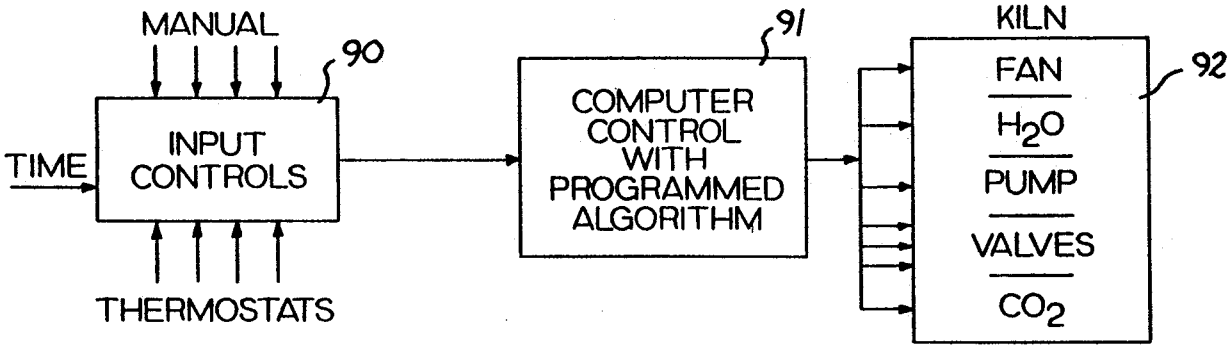
FIG. 6 is a block diagram sketch of an automated control system embodiment of the invention.

The curing cycles of this invention are readily automated or semi-automated in the manner illustrated by FIG. 6. The various input controls of the thermostats, or manual entries all related as a function of time are illustrated at block 90. This input to the computer 91 controlled by an appropriate program algorith thus establishes a control sequence for operation of the kiln accessories 92, namely the fan for timing and speed, the well water for entry and removal, the hot liquid pump and pump speed, the individual valves for the different grates and the $CO_2$ enrichment during the carbonization phase for temperature controls.

It is therefore evident that features of the invention, comprising the kiln, its control features and the method of operating the kiln have advanced the state of the art. Thus those features of novelty setting forth the spirit and nature of the invention are defined with particularity in the following claims.

I claim:

1. The system for curing concrete products in a kiln, comprising in combination, a kiln for holding therein during a cure cycle a stationary charge of concrete products arranged in a plurality of vertically disposed layers, a water retaining well disposed below the lowermost of the vertically disposed layers, at least one water heating grate disposed at a vertical position in the well adapted for underwater location during at least a portion of a curing cycle, an air circulating fan disposed for blowing heated curing air over water disposed in the well, and curing control means for regulating the flow of heated curing air, the water temperature and the level of water in said well during a curing cycle.

2. The system of claim 1 further comprising water evaporation humidifying means for arranging a thin film of water on a heated grate for accelerating evaporation of water in the well into the kiln atmosphere.

3. The system of claim 1 further comprising air drying means operable near the end of the curing cycle for removing water from the well for heating the kiln in the absence of water in the well.

4. The system of claim 1 further comprising air humidifying means operating said air circulation fan to ripple the surface of water in the well, thereby to accelerate evaporation.

5. The system of claim 4 further comprising a set of baffles positioned along the array to divert air circulation toward the surface of the water.

6. The system of claim 1 further comprising means to introduce carbon dioxide to the fan for circulation through the kiln during a portion of the curing cycle accompanying the release of water from green concrete products.

7. The system of claim 1 further comprising a set of baffles located to deflect air blown from said fan in a circulation path upwardly through said layers.

8. The system of claim 1 wherein the curing control means further comprises automatic control means for regulating water and air temperature as a function of time during the curing cycle.

9. The system of claim 1 further comprising water heating means for water in said well including a heated liquid source and a pump circulating heated liquid from said source through said grate.

10. The system of claim 9 further comprising thermostatic control means for regulating the flow of heated liquid through said grate in response to sensed kiln temperature as a function of cycle time.

11. The system of claim 9 further comprising oil as the heated liquid circulated by said pump.

12. The system of claim 1 further comprising a kiln system with at least three kilns as defined in claim 1, wherein the curing control means further comprises a fluid pump for commonly pumping heating fluid to grates in the three kilns independently as the separate kilns undergo a curing cycle, and a heated curing air source commonly supplying heating air to the three kilns independently as the separate kilns undergo a curing cycle.

13. The system of claim 1 including a plurality of grates arranged longitudinally in said well, wherein said curing control means further comprises for control of the water temperature means for circulating a heated liquid through the grates and means for individually controlling the flow through the individual grates as a function of the kiln temperature in the vicinity of the individual grates.

14. The system of claim 1, wherein the curing control means further comprises timing means for controlling temperature of the water in the kiln by means of said heating grates in three sequential curing steps whereby an initial low temperature is sustained during a period of exothermic reaction in the concrete products, an intermediate temperature level is introduced for inducing evaporation of water from the well to increase humidity in the kiln, and a higher temperature level is introduced near the end of the curing cycle to evaporate residual moisture from the concrete products.

15. A kiln for curing concrete products comprising in combination, kiln heating means comprising a pool of water, at least one heating grate introduced underwater close to the water upper surface for heating the water and means to control the constituency of the heated air during a curing cycle to enrich the carbon dioxide content of the air.

16. The kiln defined in claim 15 further comprising evaporation inducing means operable for ruffling the water surface to expose the heating grates, thereby to accelerate the evaporation of water from the pool into the kiln.

17. The kiln defined in claim 16 wherein the evaporation inducing means further comprises hot air circulation means and baffles to direct circulating air into the upper water surface.

18. The kiln defined in claim 15 further comprising means for circulating a heated liquid through the grate as a function of time for controlling curing temperature in the kiln.

19. The kiln defined in claim 18 further comprising additional kiln heating means comprising means to circulate heated air over the water surface.

20. The method of curing concrete products in a kiln comprising the steps of:

introducing a pool of water in the kiln, providing at least one underwater grate in said pool, heating the grate during an initial portion of a concrete curing cycle as the sole vehicle to change the pool water temperature by circulating a hot liquid therethrough at a predetermined rate and temperature, circulating heated air in the kiln to supplement the circulating hot liquid at a later portion of the curing cycle, and enriching the $CO_2$ in the circulating air.

21. The method of claim 20 further comprising the steps of disposing the grate near the surface of the pool, and agitating the water in the pool to expose the grate.

22. The method of claim 20 further comprising the steps of disposing a plurality of grates in said pool, and individually controlling the temperature of the pool water in the vicinity of the grates by means of said circulating hot liquid.

23. The method of curing concrete products in a kiln comprising the steps of:

introducing a pool of water in the kiln, providing at least one underwater grate in said pool, heating the grate during an initial portion of a concrete curing cycle as the sole vehicle to change the pool water temperature by circulating a hot liquid therethrough at a predetermined rate and temperature, circulating heated air in the kiln to supplement the circulating hot liquid at a later portion of the curing cycle, and removing water from the pool at a terminal portion of the curing cycle to heat the products solely by circulating heated air.

* * * * *